US006075434A

United States Patent [19]

Rueckling

[11] Patent Number: 6,075,434

[45] Date of Patent: Jun. 13, 2000

[54] FUSIBLE ELEMENT FOR AN ELECTRICAL FUSE

[75] Inventor: Hans-Werner Rueckling, Trossenfurt, Germany

[73] Assignee: Ferraz S.A., France

[21] Appl. No.: 09/233,307

[22] Filed: Jan. 19, 1999

[51] Int. Cl.[7] ..... H01H 85/11; H01H 85/10; H01H 85/08; H01H 85/06

[52] U.S. Cl. ..... 337/160; 337/159; 337/290; 337/295; 337/296; 29/623

[58] Field of Search ..... 337/159, 160, 337/296, 152, 216, 270, 290, 295; 29/623

[56] References Cited

U.S. PATENT DOCUMENTS

| | | | |
|---|---|---|---|
| 2,703,352 | 3/1955 | Kozacka | 337/163 |
| 3,113,195 | 12/1963 | Kozacka | 337/160 |
| 3,123,694 | 3/1964 | Kozacka | 337/159 |
| 3,148,257 | 9/1964 | Feenan et al. | 337/295 |
| 5,673,014 | 9/1997 | Domantis | 337/160 |

FOREIGN PATENT DOCUMENTS

| | | |
|---|---|---|
| 3239903 C2 | of 0000 | Germany . |
| PS 668 586 | of 0000 | Germany . |

*Primary Examiner*—Leo P. Picard
*Assistant Examiner*—Anatoly Vortman
*Attorney, Agent, or Firm*—Mark Kusner

[57] ABSTRACT

A fusible element for an electrical fuse comprising a generally flat, strip-shaped body having a generally uniform cross-section; a constricted area formed in the body has a cross-section less than the cross-section of the body; an indentation formed in the body at least bordering on the constricted area; a solder coating disposed within the indentation; and a first solder stop coating on a first surface of the body that is disposed adjacent the solder coating to prevent migration of the coating along the surface.

18 Claims, 3 Drawing Sheets

FUSIBLE ELEMENT FOR AN ELECTRICAL FUSE

FIELD OF THE INVENTION

The present invention relates to a fusible element for an electrical fuse.

BACKGROUND OF THE INVENTION

Electrical fuses that have a fusible element are used to prevent overcurrents in low voltage systems. In the event of an overcurrent, the fusible element melts at the narrowest point of a constricted area (the so-called "narrow point") and breaks the electrical connection. A fusible element of this type must satisfy two requirements. First, it must safely break short circuit currents with a very short reaction time. Second, it must also protect the electrical system components from prolonged periods of small overcurrent conditions. In other words, the fusible element must withstand current strengths that exceed a rated current strength by a specific amount for a limited period without causing the fusible element to trip (so-called slow-action breaking characteristic). For example, a fuse with a rated current strength of 16 amperes must be able to withstand 1.25 times this rated current strength (i.e., must withstand 20 amperes) for at least one hour without melting the fusible element.

The tripping of the fusible element during an overcurrent condition is achieved by virtue of the fact that a coating of solder is applied to the body of the fusible element. The body of the fusible element is generally made of copper (Cu) or silver (Ag). In response to an overcurrent condition when the temperature in the constricted area reaches the melting point of the solder, the solder melts and combines with the element material. Some of the element material mixes with the molten solder. The alloy coating thus produced has a higher electrical resistance than the element material. This means that the temperature of the fusible element can withstand is again decreased. This, in turn, speeds up the destruction of the fusible element.

This process is primarily effected by the constructive design of the fusible element and by the materials used. It has been found that solders that have good flow characteristics, for example pure tin (Sn 99.9), when they melt at the narrow point of the constricted area, flow uncontrollably beyond the narrow point and spread over the surface of the fusible element. This leads to poorly reproducible breaking characteristics in the event of an overcurrent, or to a failure of the fuse due to the lack of solder at the narrow point. To overcome this problem, solders used in conventional fusible elements contain additives, for example cadmium (Cd), to prevent their flowing onto the fusible element.

SUMMARY OF THE INVENTION

It is an object of the present invention to provide a fusible element for an electrical fuse.

It is another object of the present invention to provide a fusible element as described above that includes a solder coating disposed on the fusible element.

It is another object of the present invention to provide a fusible element as described above wherein at least one solder stop is provided on the fusible element to confine the solder coating.

Another object of the present invention is to provide a fusible element for an electrical fuse that includes a solder coating that does not contain any additives, such as cadmium.

In accordance with the present invention, there is provided a fusible element for an electrical fuse comprised of a generally flat, strip-shaped body of generally uniform cross-section having a constricted area formed therein. The constricted area has a cross-section less than the cross-section of the body. An indentation is formed in the body, the indentation in the body at least bordering on the constricted area. A solder coating is disposed within the indentation. A first solder stop coating is provided on a first surface of the body. The first solder stop coating is disposed adjacent the solder coating to prevent migration of the coating along the first surface.

The present invention provides a fusible element wherein the solder coating on the fusible element is confined to the vicinity of the constricted area such that molten solder, resulting from an overcurrent condition, will not flow away from the constricted area and spread uncontrollably over the surface of the body of the fusible element, and thereby destroy the effectiveness of the element. The solder is confined, by the solder stop coating, to the vicinity of the constricted area where it forms an adequately sized reservoir so as to bring about the destruction of the fusible element at this location in the event of an overcurrent. This increases the reproducibility of the breaking characteristics of the fuse when tripped so that even solders which do not contain special additives (which are often toxic) designed to inhibit their flow properties can be used.

In a preferred embodiment of the invention, the indentation and constricted area preferably overlap at least partially. More preferably, the indentation projects at least partially into the constricted area. Most preferably, the indentation and the solder coating extend up to the narrowest point in the constricted area. This ensures that the solder coating is in the area at which the highest temperature occurs, and shall start to melt quickly in the event of an overcurrent so that the base material can diffuse easily therein.

In another preferred embodiment of the invention, the first solder stop coating is disposed along a surface of the strip-shaped body and extends from the narrowest point of the constricted area to one edge of the constricted area. In other words, the first solder stop preferably covers the portion of the constricted area that is not covered with the solder coating. This prevents the solder from flowing away from the constricted area.

In a still further embodiment of the present invention, the surface of the constricted area on the opposite side of the body has a second solder stop coating. This prevents the melted solder from penetrating the body through holes caused by the combination of the solder coating with body material. Absent this second solder stop coating, the solder could escape onto the flat side opposite the solder coating through the constricted area and spread onto the body material away from the constricted area.

To prevent the solder coating from flowing onto the opposite side of the body when the solder coating completely melts, in a further preferred embodiment of the invention, there is provided a third solder stop coating on the same side of the body as the first solder stop coating. The third solder stop coating is disposed on the body such that the third solder stop coating is separated from the first solder stop coating by the solder coating in the indentation.

In accordance with the present invention, the solder coating is preferably formed of a solder material that contains no cadmium. This insures that harm to the environment caused by the production of the fusible element and by the disposal of the tripped fuses is reduced. The solder stop coatings heretofore described are preferably formed of a heat-stable material, and more preferably, of a hardening adhesive. A coating of this nature may be applied to the body during production, and is chemically passive with respect to the material used for the body. If a liquid metal is used, the thickness of the solder stop coating is preferably at least 10 μm. If a thermally hardening adhesive is used, the solder stop coating is preferably at least 0.3 mm. This insures that the melted solder is effectively prevented from flowing away.

In accordance with another aspect of the present invention, there is provided a fusible element for an electrical fuse comprised of a generally flat, strip-shaped body having a generally uniform cross-section. A row of generally aligned, spaced apart apertures extends generally transverse to the longitudinal axis of the body. The apertures define a plurality of constricted areas between the adjacent apertures. A groove extends across the body generally parallel to the row of apertures. A least a portion of the groove borders on the constricted areas defined by the apertures. A solder coating is disposed within the groove.

In accordance with another aspect of the present invention, there is provided an electrical fuse comprised of a casing, and a fusible element within the casing. The fusible element is comprised of a generally flat, strip-shaped body having a generally uniform cross-section. A row of generally aligned, spaced apart apertures extends generally transverse to the longitudinal axis of the body. The apertures define a plurality of constricted areas between the adjacent apertures. A groove extends across the body generally parallel to the row. At least a portion of the groove borders on the constricted areas defined by the apertures. A solder coating is disposed within the groove.

BRIEF DESCRIPTION OF THE DRAWINGS

To further explain the invention, refer to the design examples shown in the drawings. The drawings show as follows.

DETAILED DESCRIPTION OF PREFERRED EMBODIMENT

Figure 1:
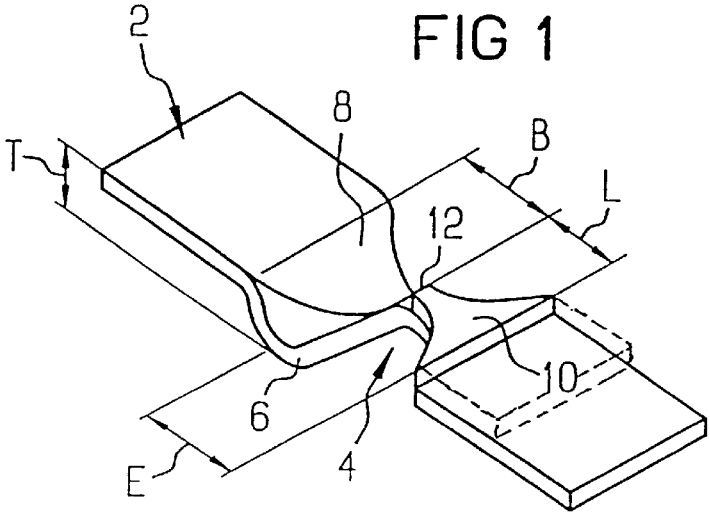
FIG. 1 is a schematic, perspective view of a fusible element illustrating a preferred embodiment of the present invention.
Figure 4:
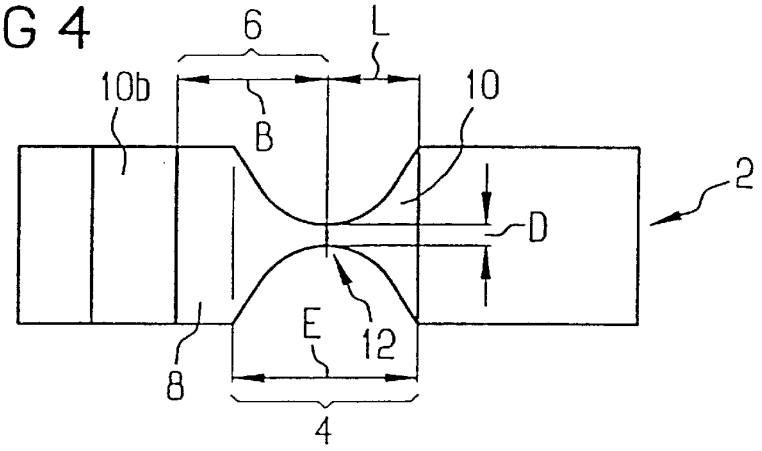
FIG. 4 is a top plan view of the fusible element shown in FIG. 3.

Referring now to the drawings wherein the showing is to illustrate preferred embodiments of the invention and not for the purpose of limiting same, FIG. 1 shows a fusible element illustrating a preferred embodiment of the present invention. The fusible element is comprised of a generally flat, strip-shaped body (2), made for example of copper (Cu) or silver (Ag), that has a constricted area (4). The constricted area (4) is formed by two side indentations (6) formed opposite each other in the sides of body (2). The body (2) has a gully-shaped recess or indentation (6) in an area bordering the constricted area (4). In the embodiment shown, recess or indentation (6) extends generally transverse to the longitudinal axis of strip-shaped body (2) to the longitudinal or side edges of the body (2), as best seen in FIGS. 1 and 4. The indentation (6) forms a trough for holding a solder coating (8).

The constricted area (4) has a first solder stop coating (10). First solder stop coating (10) is disposed on the side of body (2) in contact with solder coating (8). In other words, the first solder stop coating (10) is on the same surface of body (2) as is solder coating (8), i.e., on the flat side of the body (2) facing and contacting the solder coating (8). The solder coating (8) and the first solder stop coating (10) are disposed to be adjacent and border on each other at the narrowest point (12) of the constricted area (4).

The constricted area (4) and the indentation (6) overlap such that the narrowest point (12) lines up with one edge or side of the indentation (6), that side or edge being the side or edge nearest the constricted area (4).

In a preferred embodiment, the depth T of the indentation (6), taken from the upper surface of body (2) to the upper surface of indentation (6) as shown in FIG. 1, is between 0.1 and 0.2 mm, and more preferably, is about 1.2 mm. As best seen in FIG. 1, indentation (6) has a dimension "B," measured along the longitudinal length of body (2) of about 3 mm. Constricted area (4) has a dimension "E" of about 2.5 mm. The first solder stop coating (10) extends from the narrowest point (12) away from the solder coating (8) up to the limit of the constricted area (4). In the embodiment shown, the first solder stop coating (10) has a dimension "L" that is half the size of dimension "E" of the constricted area (4). In the embodiment heretofore described, dimension "L" is about 1.25 mm.

Figure 2:
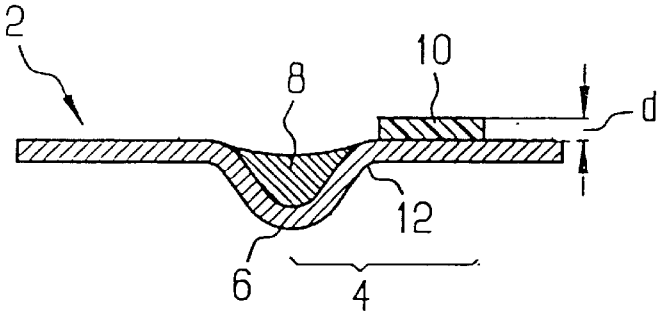
FIG. 2 is a sectional view of the fusible element shown in FIG. 1.

FIG. 2 shows that the indentation (6) forms a trough or pit to hold the solder coating (8). Ideally, easy flowing solders, in particular cadmium-free solders, such as for example, pure tin (Sn 99.9) or a tin/bismuth alloy (for example SnBi 87/13), are suitable for use as the solder coating (8). The flux required to apply the solder coating (8), for example solder oil or its residue, remains on the fusible element. Such flux is not shown in the FIGURES to achieve maximum clarity.

Suitable heat-stable materials for the first solder stop coating (10) include, by way of example and not limitation, zinc (Zn) or aluminum (Al) that can be sprayed onto the surface of the body (2). All materials which offer adequate adhesion to body (2) and are resistant to temperatures of at least up to around 350° C. are, in principle, suitable for use as materials for the solder stop coating (10). Materials which can be hardened thermally or by UV radiation are particularly suitable for this purpose. For example, a thermally hardening adhesive manufactured by Grace, under the trade designation Amicon D 125 F4, or a silicon which is hardened by UV radiation manufactured by Loctite, under the trade designation Type 5091, find advantageous application as solder stop coating (10). The coating thickness "d" of the first solder stop coating (10), if a liquid metal is used, is preferably at least about 10 μm. If an adhesive is used, it is preferable to provide a greater coating thickness "d," in particular at least about 0.3 mm.

Figure 3:
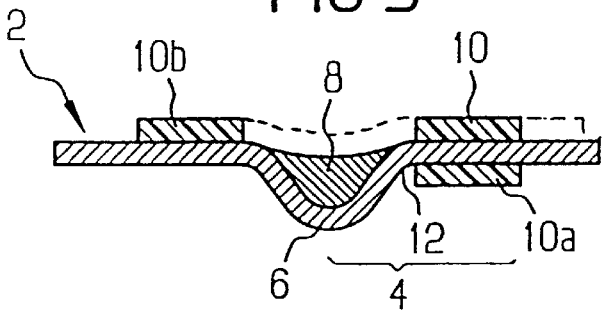
FIG. 3 is a sectional view of a fusible element illustrating an alternate embodiment of the present invention.

In the embodiment shown in FIG. 3, a second solder stop coating (10*a*) is applied on the flat, opposite side of body (2), i.e., on the side of body (2) that does not face the solder coating (8). Second solder stop 10*a* is preferably disposed on the portion of the constricted area (4) designated "E." In this respect, the second solder stop coating (10*a*) is preferably in the same relative area of the constricted area (4) as is the first solder stop coating (10), and like first solder stop coating 10 also extends only up to the narrowest point (12). The second solder stop coating (10*a*) has approximately the same thickness as the first solder stop coating (10). This second solder stop coating (10*a*) is provided to prevent the solder from escaping on the underside of the body (2) through the constricted area (4).

A third solder stop coating (10*b*) is provided on the solder side of body (2), i.e., the side of body (2) having solder stop coating 10. Third solder stop coating (10*b*) borders on indentation (6) on the side facing away from the constricted area (4). This third solder stop coating (10*b*) prevents solder coating (8) escaping on surface of body (2) to the side that extends away from constricted area (4). Third solder stop coating (10*b*) preferably has about the same thickness as first solder stop coating (10*a*).

In the plan view shown in FIG. 4, in addition to the dimensions shown in FIG. 1, the dimension "D" illustrates the width of the body (2) at the narrowest point (12). This FIG. 4 shows clearly that the constricted area (4) and the indentation (6) overlap, and that the indentation (6) extends to the narrowest point (12) of the constricted area (4).

Figure 5A:
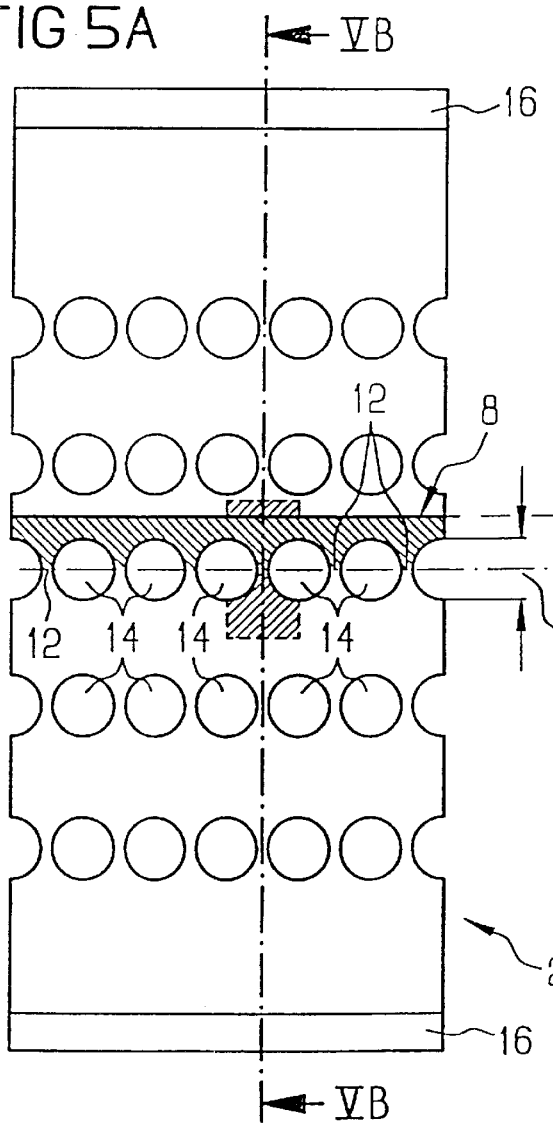
FIG. 5*a* is a plan view of a fusible element having a large number of narrow points formed by recesses illustrating an alternate embodiment of the present invention.
Figure 5B:
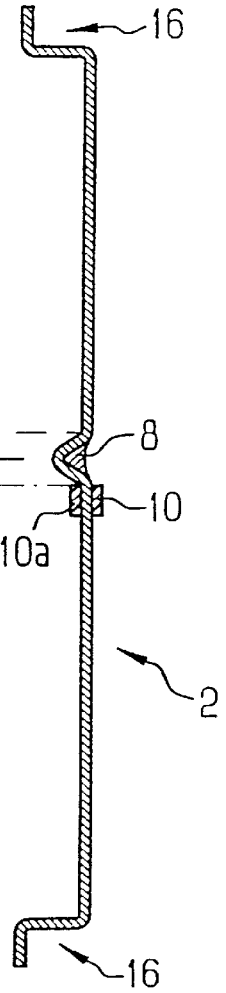
FIG. 5*b* is a sectional view of the fusible element shown in FIG. 5*a*.

The embodiments shown in FIGS. 5*a* and 5*b* have a fusible element whose constricted area (4) include a plurality of narrowest points (12). These narrowest points (12) are spaced apart by permanent struts between a large number of recesses (14) that are aligned in rows generally transverse to the longitudinal direction of the body (2). In the embodiment shown, recesses (14) are circular. A gully-shaped indentation (6) extends into a constricted area (4) that is highlighted by cross hatching in FIG. 5*a*. The gully-shaped indentation (6) is disposed to extend similarly to the design example in FIGS. 1–4, i.e., up to the middle of the constricted area (4) to the narrowest points (12). In this embodiment, a first solder stop coating (10) and a second solder stop coating (10*a*) are provided to connect the opposite surfaces of the body (2) at the edge of the indentations (6). Expansion bars (16) are used to compensate for the length tolerances of a fuse sleeve designed to hold the body (2).

FIG. 5*a* also shows, by means of the section that is shown in angled hatching, that the embodiment shown in FIGS. 1–4 can be regarded as "elementary cells" of a fusible element as shown in FIGS. 5*a* and 5*b*.

Figure 6:
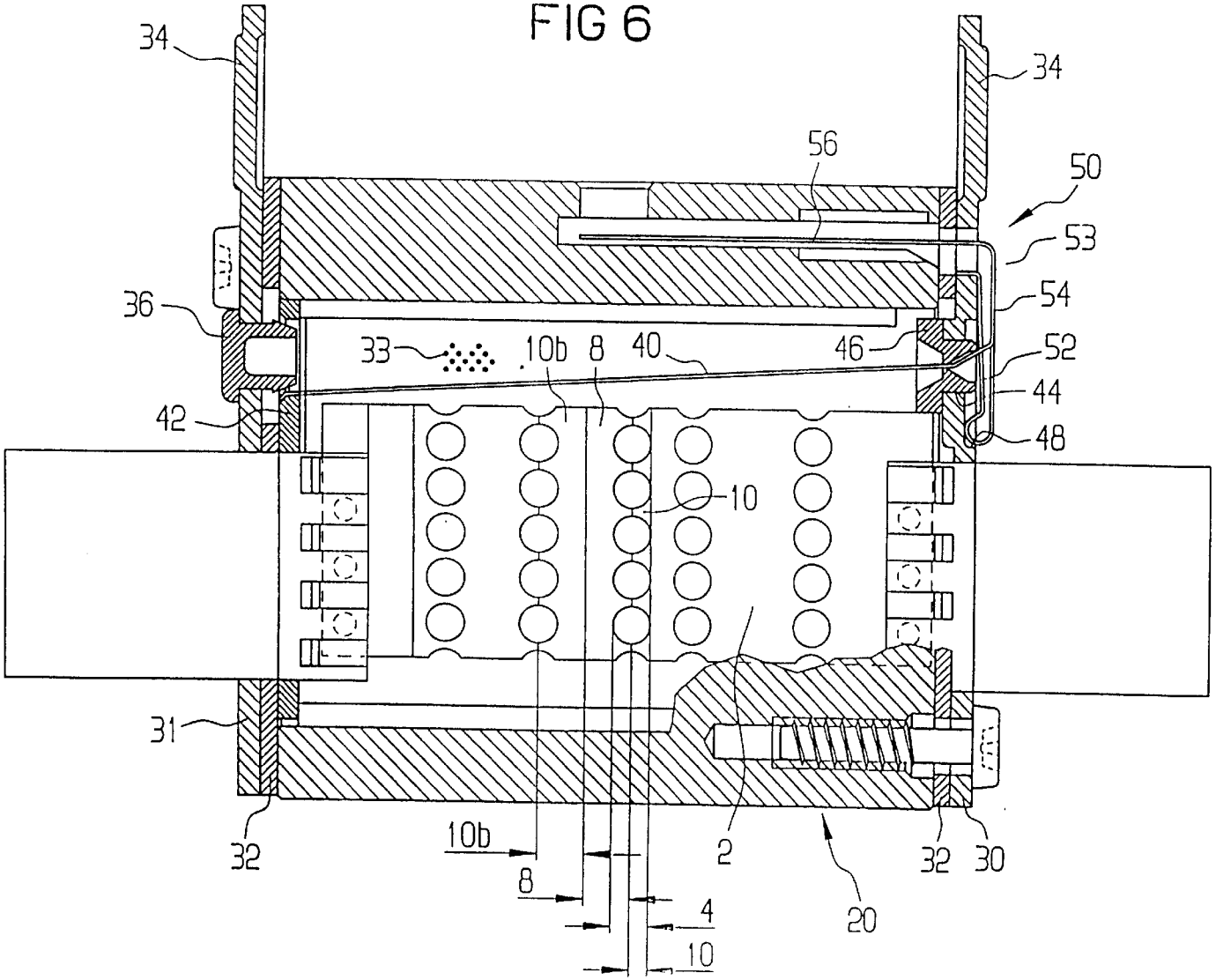
FIG. 6 is a sectional view of an electrical fuse with an integral fusible element illustrating a still further embodiment of the present invention.

FIG. 6 shows a low voltage high-breaking-capacity electrical fuse that is made up of a casing (20). Body (2) of the fusible element is positioned between two contact blades (26) located at the ends of casing (20).

Casing (20) is comprised of a sleeve-shaped casing jacket (28) that is made of an insulated material such as a ceramic. Casing jacket (28) is bolted to an end plate (30) and to a base plate (31) at its ends. Between end plate (30) and base plate (31) and casing jacket (28), there are provided seals (32) to seal the interior of casing (20) against the external air and to prevent quenching sand (33) inside casing (20) from escaping.

End plate (30) and base plate (31) are each fitted with a handle (34) which projects over casing jacket (28). A cap (36) in base plate (31) seals the interior of casing (20) after it has been filled with quenching sand (33). Inside casing (20) there is a fusible indicator element (40), for example a wire that is connected in parallel to body (2). Fusible indicator element (40) is fixed in the area of base plate (31) to an intermediate plate (42), for example by spot welding, and connected to contact blade (26) on base plate (31).

In end plate (30) there is provided an insulated bushing or sleeve (46) fitted in an aperture (44). Fusible indicator element (40) is fed through aperture (44). Aperture (44) opens into an indentation (48) in end plate (30). A base leg portion (52) of an indicator unit (50) is inserted into this indentation (48) and fixed therein by compressing the side edge of indentation (48).

An indicator unit (50) includes a bent, L-shaped indicator element (53), that is comprised of a first leg (54) and a second leg (56). Second leg (56) extends generally perpendicular to first leg (54). First leg (54) can be pivoted about an axis which is perpendicular to the drawing plane and parallel to end plate (30). In the preferred embodiment shown in FIG. 6, indicator unit (50) is a single part and is comprised of a spring plate. Base leg (52) and first leg (54) form a leg spring which is fixed using the indicator fusible element on first leg (54) in a prestressed position such that base leg (52) and first leg (54) are almost parallel to each other, in other words, the leg spring is closed.

Body (2) is positioned in casing (20) of the electric fuse in such a way that solder coating (8), viewed from end plate (30) or the sand filling side (base plate 31) is always on the same side of constricted area (4). In this design example, this is the side of constricted area (4) that faces away from end plate (30). This means that a high level of reproducibility in the breaking characteristics of the low-voltage, high-breaking-capacity fuse can be insured, as long as it is fitted in the same position in the fuse box (with the indicator at the top).

Having described the invention, the following is claimed:

1. A fusible element for an electrical fuse, comprised of:

a generally flat, strip-shaped body having a generally uniform cross-section;

a constricted area formed in said body, said constricted area having a cross-section less than the cross-section of said body;

an indentation formed in said body, said indentation in said body at least bordering on the constricted area;

a cadmium-free and lead-free solder coating disposed within said indentation; and a first solder stop coating on a first surface of said body, said first solder stop coating disposed adjacent said solder coating to prevent migration of said coating along said first surface.

2. An element as defined in claim 1, wherein said at least a portion of said indentation is formed in said constricted area.

3. An element as defined in claim 1, wherein said constricted area is of varying cross-section and includes a section of narrowest cross-section, and said indentation extends to the section of narrowest cross-section.

4. An element as defined in claim 3, wherein said first solder stop coating extends from the edge of said indentation at least to the edge of said constricted area.

5. An element as defined in claim 1, wherein said fusible element includes a second solder stop coating on a second surface of said body, said second surface being on a side of said flat body opposite to said first surface, said second solder stop coating disposed on said second surface to be approximately in registry with said first solder stop coating relative to said solder coating.

6. An element as defined in claim 5, further comprising a third solder stop coating on a third surface of said body, said third surface being on the same side of said body as said first surface and being separate from said first surface by said indentation wherein said first solder stop coating is separated from said third solder stop coating by said solder coating.

7. An element as defined in claim 6, wherein said first, second and third solder stop coatings are formed of a heat-stable material.

8. An element as defined in claim 7, wherein said heat-stable material is a thermally hardening adhesive.

9. An element as defined in claim 8, wherein the thickness of said adhesive is at least 0.3 mm.

10. An element as defined in claim 7, wherein said heat-stable material is a sprayable liquid metal.

11. An element as defined in claim 10, wherein the thickness of said sprayable liquid metal is at least 10 $\mu$m.

12. A fusible element for an electrical fuse, comprised of:

a generally flat, strip-shaped body having a generally uniform cross-section;

a row of generally aligned, spaced apart apertures extending generally transverse to the longitudinal axis of said body, said apertures defining a plurality of constricted areas between adjacent apertures;

a groove extending across said body generally parallel to said row, at least a portion of said groove bordering on said constricted areas defined by said apertures;

a cadmium-free and lead-free solder coating disposed within said groove; and a first solder stop coating on a first surface of said body, said first solder stop coating disposed adjacent said solder coating to prevent migration of said solder coating along said surface.

13. An element as defined in claim 12, wherein said first solder stop coating extends from the edge of said groove at least to the edge of said constricted area.

14. An element as defined in claim 12, wherein said fusible element includes a second solder stop coating on a second surface of said body, said second surface being on a side of said flat body opposite to said first surface, said second solder stop coating disposed on said second surface to be approximately in registry with said first solder stop coating relative to said solder coating.

15. An electrical fuse, comprised of:

a casing; and a fusible element within said casing, said fusible element comprising:

a generally flat, strip-shaped body having a generally uniform cross-section;

a row of generally aligned, spaced apart apertures extending generally transverse to the longitudinal axis of said body, said apertures defining a plurality of constricted areas between adjacent apertures;

a groove extending across said body generally parallel to said row, at least a portion of said groove bordering on said constricted areas defined by said apertures;

a cadmium-free and lead-free solder coating disposed within said groove; and a first strip of a solder stop coating disposed on a first surface of said body, said first strip of solder stop coating disposed to one side of said solder coating and bordering said solder coating at the narrowest point of said constricted areas.

16. A fuse as defined in claim 15, further comprising: a quenching material disposed within said casing surrounding said fusible element.

17. A fuse as defined in claim 16, wherein said quenching material is sand.

18. A fuse as defined in claim 16, further comprising a second strip of a solder stop coating disposed on a second surface of said body adjacent said groove.

* * * * *